United States Patent [19]

Williams et al.

[11] Patent Number: 4,771,293

[45] Date of Patent: Sep. 13, 1988

[54] DUAL REFLECTOR FOLDING ANTENNA

[75] Inventors: Andrew Williams, High Wycombe; Eric G. Matthams; Bernard F. Payne, both of Chelmsford, all of England

[73] Assignee: The General Electric Company p.l.c., Chelmsford, England

[21] Appl. No.: 795,528

[22] Filed: Nov. 6, 1985

[30] Foreign Application Priority Data

| | | | |
|---|---|---|---|
| Nov. 7, 1984 | [GB] | United Kingdom | 8428155 |
| Jan. 25, 1985 | [GB] | United Kingdom | 8501944 |
| Feb. 1, 1985 | [GB] | United Kingdom | 8502631 |
| Sep. 19, 1985 | [GB] | United Kingdom | 8523164 |

[51] Int. Cl.[4] ..... H01Q 1/08; H01Q 19/18

[52] U.S. Cl. ..... 343/757; 343/881

[58] Field of Search ..... 343/915, 916, DIG. 2, 343/880–882, 840, 839, 912, 757, 878, 837, 713, 761, 781 P, 781 CA

[56] References Cited

U.S. PATENT DOCUMENTS

| | | | |
|---|---|---|---|
| 3,646,564 | 2/1972 | Drislane | 343/881 |
| 3,747,113 | 7/1973 | De Vellis | 343/881 |
| 4,314,253 | 2/1982 | Sayovitz | 343/915 |
| 4,352,113 | 9/1982 | Labruyere | 343/915 |
| 4,562,441 | 12/1985 | Beretta et al. | 343/DIG. 2 |

FOREIGN PATENT DOCUMENTS

| | | | |
|---|---|---|---|
| 2656691 | 6/1978 | Fed. Rep. of Germany | 343/DIG. 2 |

*Primary Examiner*—William L. Sikes
*Assistant Examiner*—Michael C. Wimer
*Attorney, Agent, or Firm*—Spencer & Frank

[57] ABSTRACT

A folding antenna for use in a satellite communication system comprises a box having a base (1) which forms the supporting structure for the antenna. A main reflector (16) is mounted on a platform (11) to which it is pivotted about a first axis (14). A sub-reflector (26) is pivotted to the main reflector about a second axis (21). By pivotting the sub-reflector and the main reflector downwardly they can be stowed into a position close to the base (1) and the lids (8) of the box closed to protect the system during transportation.

9 Claims, 2 Drawing Sheets

DUAL REFLECTOR FOLDING ANTENNA

BACKGROUND OF THE INVENTION

This invention relates to a folding antenna. The invention arose in the design of an antenna for use as part of a mobile earth station forming part of a satellite communication system for news gathering purposes. The size of antenna required for this purpose presents a problem with regard to transportability. It is believed that this problem can be greatly eased by employing the present invention.

SUMMARY OF THE INVENTION

The invention provides a folding antenna comprising a supporting base and a reflector characterised in that the reflector is adapted to be held in a deployed position and in a stowed position where it lies relatively close to the base and in that the base forms part of a container which encloses the reflector when in the stowed position.

The invention also provides a folding antenna comprising a base, a main reflector and a subreflector, characterised in that the reflectors are adapted to hinge relative to each other and relative to the base, from a stowed position where they lie relatively close to the base, to a deployed condition where they are relatively spaced from the base.

BRIEF DESCRIPTION OF THE DRAWINGS

One way in which the invention may be performed will now be described by way of example with reference to the accompanying drawings in which.

DETAILED DESCRIPTION OF THE PREFERRED EMBODIMENT

Figure 1:
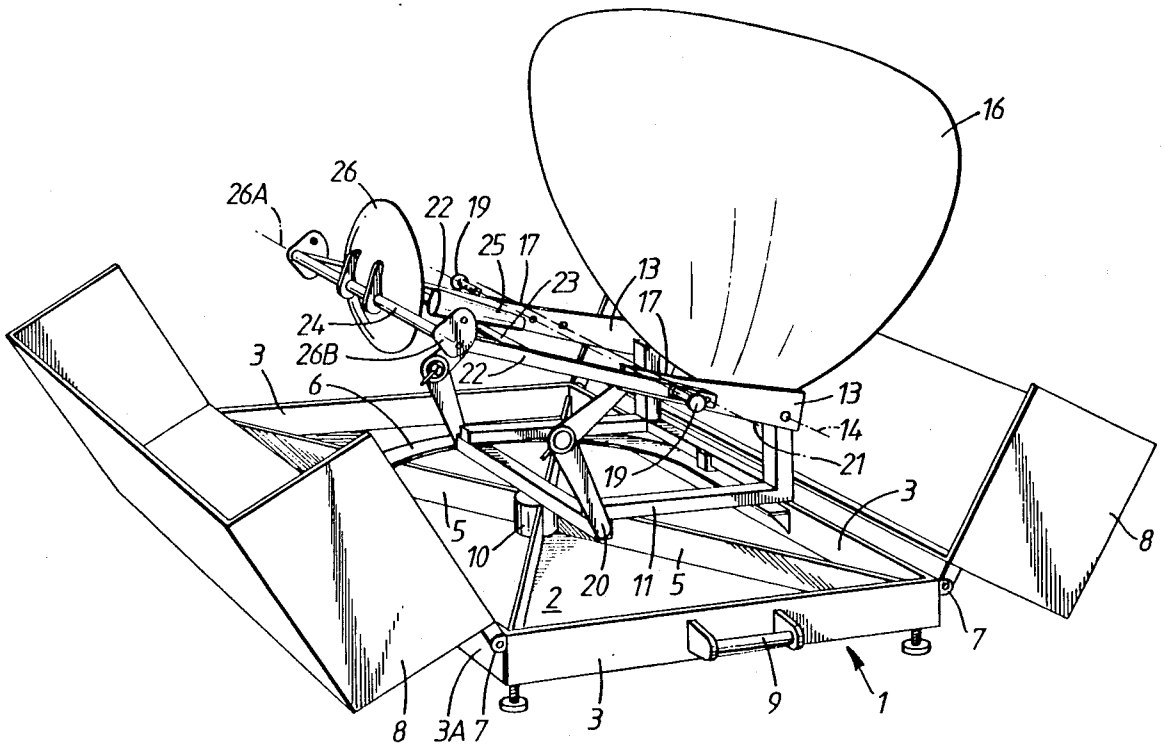
FIG. 1 is a perspective view of an antenna constructed in accordance with the invention and shown in a position between its stowed and deployed conditions.

Referring to the drawings the illustrated antenna comprises a base 1 having a floor 2, sides 3 and adjustable feet 4. Bracing strips 5 support a rail 6. Lugs 7 attached to the base are hinged to lids 8 which are shown in the open position in both FIGS. 1 and 2 of the drawings. Handles 9 on each end of the base 1 (which is rectangular) allow the whole antenna to be lifted by two people, one at each end. The base 1 includes a central boss 10 which provides a pivot for a frame 11. This frame 11 sits on the rail 6 so that it can be rotated through more than 90° about a vertical axis passing through the boss 10. A clamp (not shown) is included to hold the frame 11 at the desired position along the rail 6. The frame 11 is pivotted to two L-shaped supporting members 13 about a first horizontal axis 14. Each L-shaped supporting member 13 has an arm 15 (FIG. 2) which supports a main reflector 16, and an arm 17.

Figure 3:
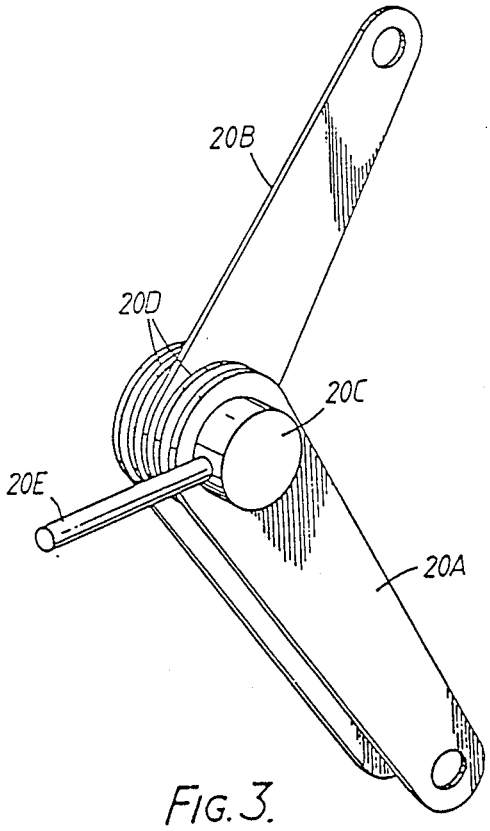
FIG. 3 illustrates, in greater detail, the stay 20 shown in FIG. 2.

Each arm 17 is pivotted to a collapsible stay 20 shown in more detal in FIG. 3. This stay 20 comprises two lower arms 20A and an upper arm 20B. The top ends of the arms 20A are pivotted by a bolt 20C to the lower end of the arm 20B with the interposition of high frictional washers 20D. A lever 20E is attached to the bolt to tighten the connection between the arms 20A and 20B and to prevent pivotting when the antenna is deployed.

The top of the arm 20B has a hole which receives a pivot (not shown) by which it is attached to the arm 17 so as to allow relative rotation. The bottom of each arm 20A also has a hole which receives a pivot pin passing through lugs attached to frame 11. The stay 20 thus allows the boresight of the reflector 16 to be adjusted in elevation.

A boom or framework consisting of frame members 22, 23 and 24, is pivotally mounted on the arms 17 of member 13 for movement about an axis 21. This framework can be held in the position illustrated in FIG. 1 by removable pins 19 which pass through the members 22. When the pins 19 are removed, the framework can be pivotted about the axis 21 to the position illustrated in FIG. 2. The framework supports, by means of the cross-member 23, a feed horn 25 which receives microwave energy along a flexible waveguide (not shown) and directs it to a concave sub-reflector 26 held on the cross-member 24 of the frame. From there the energy is reflected to the main reflector 16 and thence to a receiving station (not shown) via a satellite (also not shown).

Referring now in particular to FIG. 1, the antenna is shown almost in its deployed condition. In fact it would operate in the position illustrated but would be relatively unstable in high wind conditions because the wind force on the main reflector 16 would be supported by the smaller dimension of the rectangular base, i.e., the length of the short sides containing the handles 9. For this reason the platform 11 and everything supported on it is rotated through 90° by sliding over the rail 6 until the main reflector 16 faces in the direction of the short sides of the base 1. The reflector 16 is then adjusted in azimuth and held, in any position of the plus or minus 45° excursion available relative to the center position, by the clamp referred to previously. The stay 20 is adjusted to align the boresight of the antenna with the satellite being used. Coarse azimuth adjustment is achieved by moving the whole structure using the handles 9, with the adjustable feet being used to ensure that the base 1 is either horizontal or is inclined to the horizontal at a desired angle. In this connection it should be explained that the main reflector 16 is generally of elliptical shape having one axis (the horizontal axis as shown in FIG. 1) longer than another axis normal thereto.

In order to pack the antenna assembly away the platform 11 is rotated about an aximuth axis on the boss 10 back to the position illustrated in FIG. 1.

A location plate 26B and pins not shown which pass through the plate 26B and the framework 22, 23, 24 enable the sub-reflector 26 to be locked in deployed or stowed positions.

Releasing the screw clamps 20C of stays 20 allows the reflector 16, and the framework 22, 23, 24 carrying the sub-reflector, to pivot downwards about axis 14; until the framework 22, 23, 24 rests on the long side 3A of the base 1.

Removing the pins 19 allows the reflector 16 to continue to pivot downwards about axis 14. Simultaneously the framework 22, 23, 24 pivot with respect to the arms 17 about the axis 21.

Figure 2:
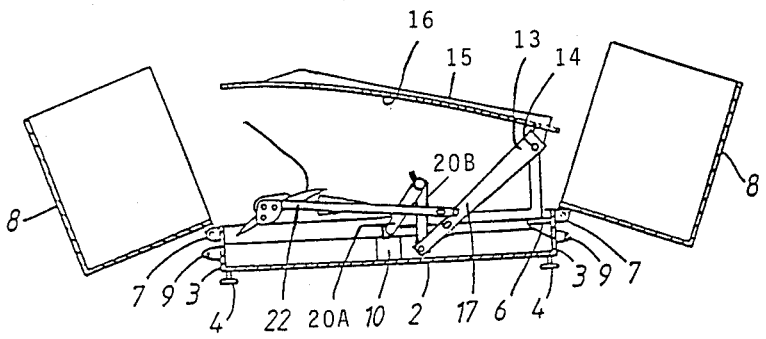
FIG. 2 illustrates a vertical cross-section through the same antenna in its stowed condition but with its protective lids shown hinged back ready for deployment of the antenna.

It is notable that during pivoting of the reflector 16, the axis 21, because of its spacing from the axis 14, is lowered towards the base 2, this resulting in a more compact arrangement when the antenna is in its stowed position as shown in FIG. 2. During pivotting of the main reflector 16 and associated parts about the axis 14 the arm 17 shown furthermost in FIG. 1 passes through a slot provided in the supporting rail 6 but not visible in the drawings. The final operation is to close the lids 8 which are held in their closed positions by a suitable catch mechanism (not shown).

The need for the pivotting movement about the central boss 10 and for the rail 6 arises from the desirability of making the box formed by the base 1 and lids 8 longer than it is wide to conform with the shape of the main reflector 16 which is also longer than it is wide. An antenna of this shape is particularly desirable for satellite communication purposes but it is of course possible that reflectors of other shapes, for example circular or square, could be used; in which case the need would not arise for rotation about the central boss and for sliding on the rail 6.

The ability of the antenna to be folded away or otherwise collapsed into a confined space can be of benefit in other transportable systems e.g., where the antenna is mounted on a vehicle or craft. In this connection the features of the present invention can be of value not only in communication systems but also in land and sea based radars.

We claim:

1. A dual-reflector folding antenna comprising: a base; a main reflector; first means for hinging said main reflector for movement relative to said base about a first axis so that said main reflector can be pivotted between a deployed position and a stowed position wherein said main reflector lies relatively parallel to said base; a sub-reflector; a boom carrying said sub-reflector; second means for hinging said boom for movement relative to said main reflector and relative to said base about a second axis parallel to said first axis so that said boom can be pivotted between a deployed position and a stowed position wherein said boom lies relatively parallel to and between said base and said main reflector; and a pivottal connection between said boom and said sub-reflector allowing said sub-reflector to be pivotted about a third axis, which is parallel to said first and second axes, between a deployed position and a stowed position wherein said sub-reflector lies relatively parallel to said boom between said base and said main reflector.

2. An antenna according to claim 1 in which said first means hinges said main reflector to said base for movement about said first axis; and in which said second means hinges said boom to said first means for movement about said second axis which is spaced from said first axis so that pivotting of said main reflector about said first axis from the deployed to the stowed position moves said second axis towards said base.

3. An antenna according to claim 1, including an elevation adjustment mechanism for adjusting the elevation of a boresight of the antenna when in its deployed position said elevation adjustment mechanism also being hinged relative to said base between deployed and stowed positions.

4. An antenna according to claim 1, in which said base forms part of a container including hinged lids for enclosing said reflectors when they are in a stowed position.

5. An antenna according to claim 2 including an elevation adjustment mechanism for adjusting the elevation of a boresight of the antenna when said antenna is in its deployed position, said elevation adjustment mechanism being hinged relative to said base between the deployed and stowed positions.

6. A folding antenna according to claim 1 wherein said main reflector and said sub-reflector are both concave.

7. A dual-reflector folding antenna comprising: a base; a main reflector; first means for mounting said main reflector on said base so that said main reflector can be pivotted about a first substantially horizontal axis between a deployed position and a stowed position wherein said main reflector lies substantially parallel to said base with the reflecting surface of said main reflector facing said base; a sub-reflector; a boom for said sub-reflector; second means for pivotally mounting one end of said boom on said first means so that said boom can be pivotted relative to said main reflector and relative to said base about a second substantially horizontal axis, which is parallel to said first axis, between a deployed position and a stowed position wherein said boom lies relatively parallel to said base between said main reflector and said base; and third means for pivotally mounting said sub-reflector on the other end of said boom so that said sub-reflector can be pivotted about a third axis, which is parallel to said first and second axes, between a deployed position and a stowed position wherein said sub-reflector lies relatively parallel to said boom between said main reflector and said base.

8. A folding antenna according to claim 7 wherein said main reflector and said sub-reflector are both concave.

9. A folding antenna according to claim 7 further comprising elevation adjusting means, pivottably connected between said base and said first means, for adjusting the elevation of a boresight of the antenna when said antenna is in its deployed position.

* * * * *